US007261429B2

(12) United States Patent
Marchese et al.

(10) Patent No.: US 7,261,429 B2
(45) Date of Patent: Aug. 28, 2007

(54) OPTICAL ASSEMBLY AND CORRESPONDING ILLUMINATION DEVICE

(75) Inventors: Christophe Marchese, Beaugency (FR); Olivier Collot, Gondreville (FR)

(73) Assignee: ALM, Ardon (FR)

( * ) Notice: Subject to any disclaimer, the term of this patent is extended or adjusted under 35 U.S.C. 154(b) by 123 days.

(21) Appl. No.: 10/969,186

(22) Filed: Oct. 21, 2004

(65) Prior Publication Data

US 2005/0083594 A1 Apr. 21, 2005

(30) Foreign Application Priority Data

Oct. 21, 2003 (FR) ..... 03 12302

(51) Int. Cl.
*G02B 5/10* (2006.01)

(52) U.S. Cl. ..... 359/852

(58) Field of Classification Search ..... 359/852
See application file for complete search history.

(56) References Cited

U.S. PATENT DOCUMENTS 3,745,993 A 7/1973 Feinbloom
4,846,570 A 7/1989 Kanai
4,938,587 A 7/1990 Namioka et al.

FOREIGN PATENT DOCUMENTS

EP 0 767 339 4/1997
GB 813 721 5/1959

*Primary Examiner*—Euncha P. Cherry
(74) *Attorney, Agent, or Firm*—Young & Thompson

(57) ABSTRACT

This optical assembly comprises a securing support (40), an optical focusing element (44) and a reflecting mirror (42) which is suitable for reflecting an incident light beam (F1) towards the optical focusing element (44) in order to focus it onto an illumination plane (P). The reflecting mirror (42) is movable relative to the securing support (40). The optical focusing element (44) is movable relative to the securing support (40). The assembly includes elements for connecting the focusing element (44) to the mirror (42) for synchronised displacement of the two of them. The assembly is useful in devices for illuminating operating fields.

20 Claims, 3 Drawing Sheets

OPTICAL ASSEMBLY AND CORRESPONDING ILLUMINATION DEVICE

TECHNICAL FIELD

The present invention relates to an optical assembly of the type comprising:

a support for securing the assembly, an optical focusing element and a reflecting mirror which is suitable for reflecting an incident light beam towards the optical focusing element in order to focus it onto an illumination plane, the reflecting mirror being movable relative to the securing support.

The invention applies in particular to devices for illuminating operating fields in the medical sector.

BACKGROUND TO THE INVENTION

Document FR-A-2 793 676 describes an illumination device which comprises a casing, in which a bulb and optical assemblies are arranged. Each optical assembly comprises a mirror and an aperture. The mirror is suitable for reflecting a light beam emitted by the bulb towards the aperture which is suitable for focusing the beam onto an illumination plane.

This device does not allow the size of the illumination spot to be varied for a given distance between the casing and the illumination plane.

There are further known illumination devices which allow the extent of the illumination spot to be varied by the mirror being tilted relative to the casing. However, these devices comprise a casing whose zones surrounding the apertures are opaque in order to ensure homogeneous illumination. These opaque zones lead to poor light output and an unattractive casing.

The object of the present invention is to overcome the disadvantages mentioned and to provide an assembly which allows the size of the illumination spot to be modified whilst still having good output.

SUMMARY OF THE INVENTION

To this end, the invention relates to an assembly of the above-mentioned type, characterised in that the optical focusing element is movable relative to the securing support, and in that it comprises means for connecting the optical focusing element to the reflecting mirror for synchronised displacement of the two of them.

According to specific embodiments, the invention comprises one or more of the following features:

the connection means fixedly join the reflecting mirror to the optical focusing element for identical movement of the two of them;

the reflecting mirror defines an optical mirror plane and the optical focusing element defines an optical focusing plane, the two optical planes intersect along an axis of intersection, and the reflecting mirror and the optical focusing element are movable in rotation about an axis of rotation which is parallel with the axis of intersection;

the assembly comprises means for adjusting the relative position of the reflecting mirror and the optical focusing element relative to the axis of rotation in a radial direction relative to this axis;

the optical focusing element is a through-aperture comprising a first dioptre lens and a second dioptre lens, in that the first dioptre lens is suitable for correcting optical aberrations and the second dioptre lens is suitable for making uniform the illumination over the illumination plane; and the reflecting mirror and the optical focusing element are mutually connected by two connection plates which extend at one side and the other of the reflecting mirror and the optical focusing element.

The invention further relates to an illumination device, in particular for illuminating an operating field, of the type comprising:

a casing comprising at least one means for securing a light source and at least one optical assembly which is suitable for reflecting a light beam which is emitted by the light source towards the illumination field, characterised in that the optical assembly is a so-called movable assembly, as defined above, the securing support being fixed to the casing.

According to specific embodiments, the device comprises one or more of the following features:

the device comprises at least two optical assemblies, of which half are movable assemblies and the other half are fixed assemblies, and each of the movable assemblies is an assembly as defined above;

half of the optical assemblies which are associated with a bulb are constituted by movable assemblies, whilst the other half of the optical assemblies are fixed assemblies.

BRIEF DESCRIPTION OF DRAWINGS

The invention will be better understood from a reading of the description below, given purely by way of example and with reference to the appended drawings, in which.

DESCRIPTION OF PREFERRED EMBODIMENT

Figure 1:
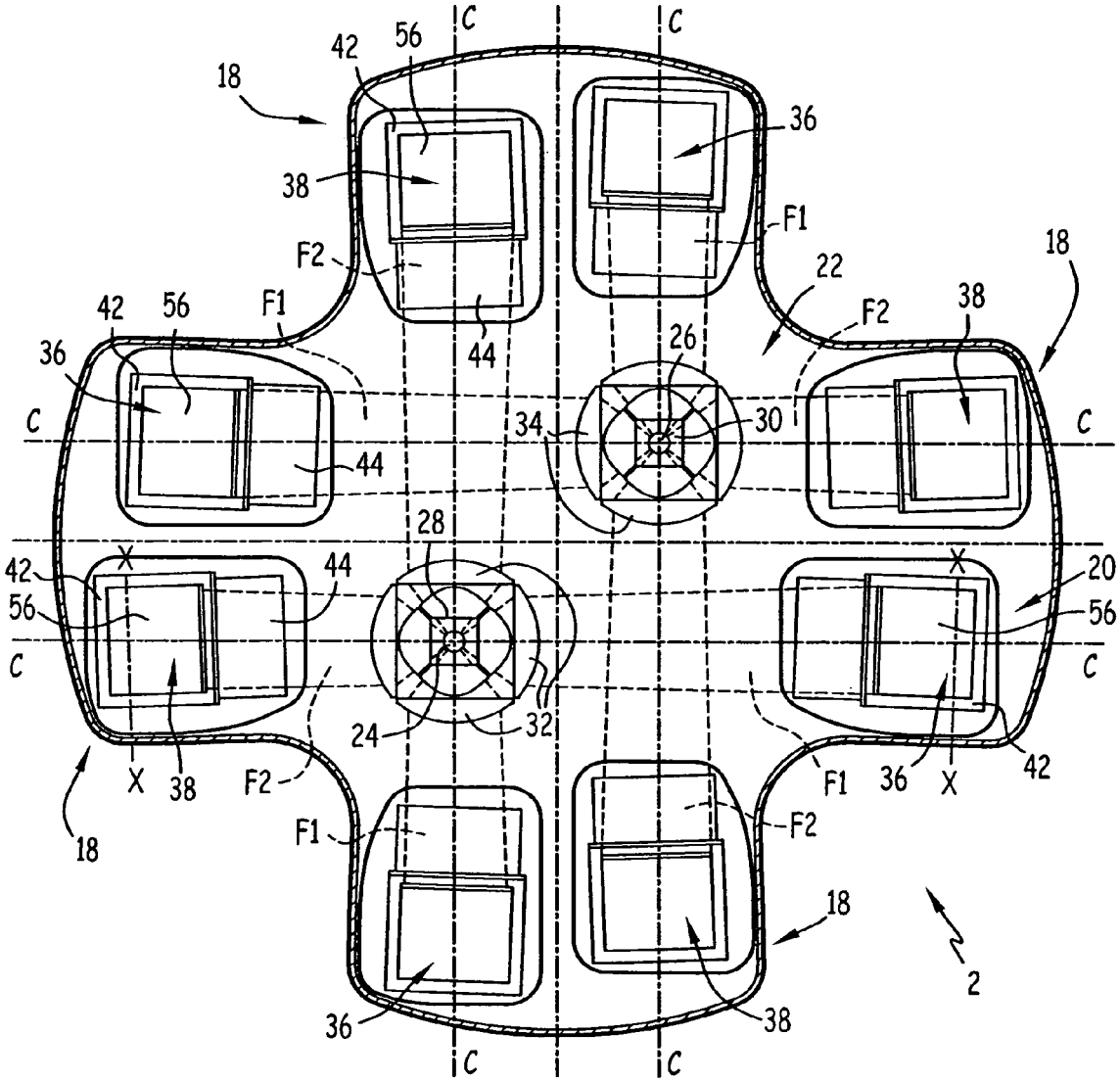
FIG. 1 is a top view of an illumination device according to the invention, the casing being removed.
Figure 2:
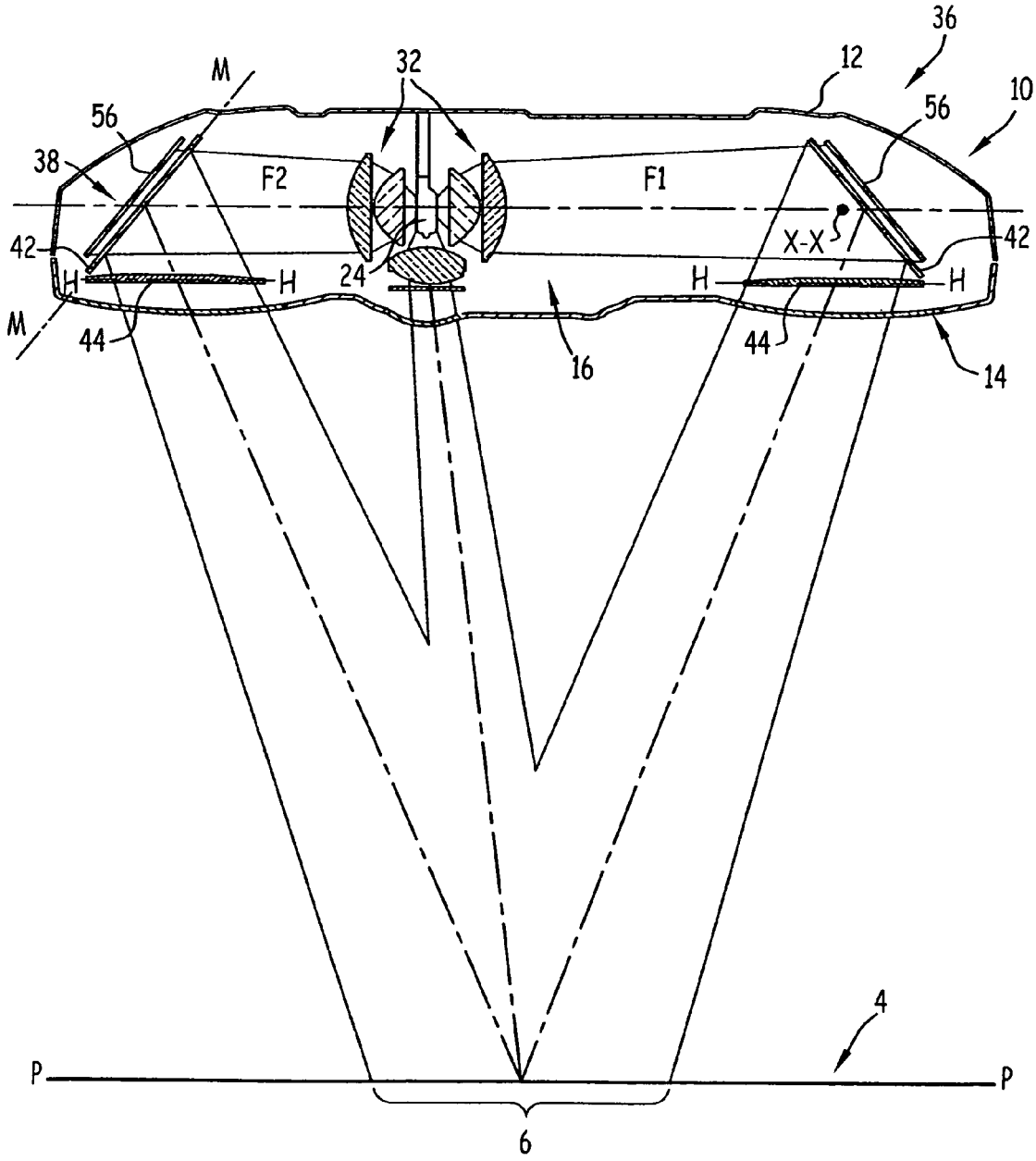
FIG. 2 is a sectioned view along plane A—A of FIG. 1.

FIG. 1 illustrates an illumination device according to the invention which is generally designated 2. This device 2 is intended to illuminate an illumination field 4, such as a medical operating field defined by an illumination plane P. To this end, the device 2 is suitable for creating an illumination spot 6 in plane P.

The device 2 is provided with a casing 10 which comprises a housing 12 and a closure plate 14. The housing 12 delimits an opening 16 which is directed towards plane P. The closure plate 14 closes the opening 16 and is completely transparent. It is produced in a single piece, for example, of plastics material. The casing 10 comprises four lobes 18 and has, when viewed from above, a generally symmetrical cross-like form.

Two illumination assemblies 20 and 22 are arranged in the casing 10.

Each of the illumination assemblies 20, 22 comprises an illumination bulb 24, 26 which is retained in a bulb securing means 28, 30 and four condenser lenses 32, 34 which are known per se and which are arranged in the central portion of the casing. The condenser lenses 32, 34 are suitable for generating four light beams F1 and F2 which are directed from the associated bulb towards the lobes 18 and which define centre axes C—C.

Each of the assemblies 20, 22 further comprises two movable optical assemblies 36 and two fixed optical assemblies 38. Each of these assemblies is arranged in one of the lobes 18 and is suitable for reflecting one of the beams F1, F2 towards the illumination plane P.

Figure 3:
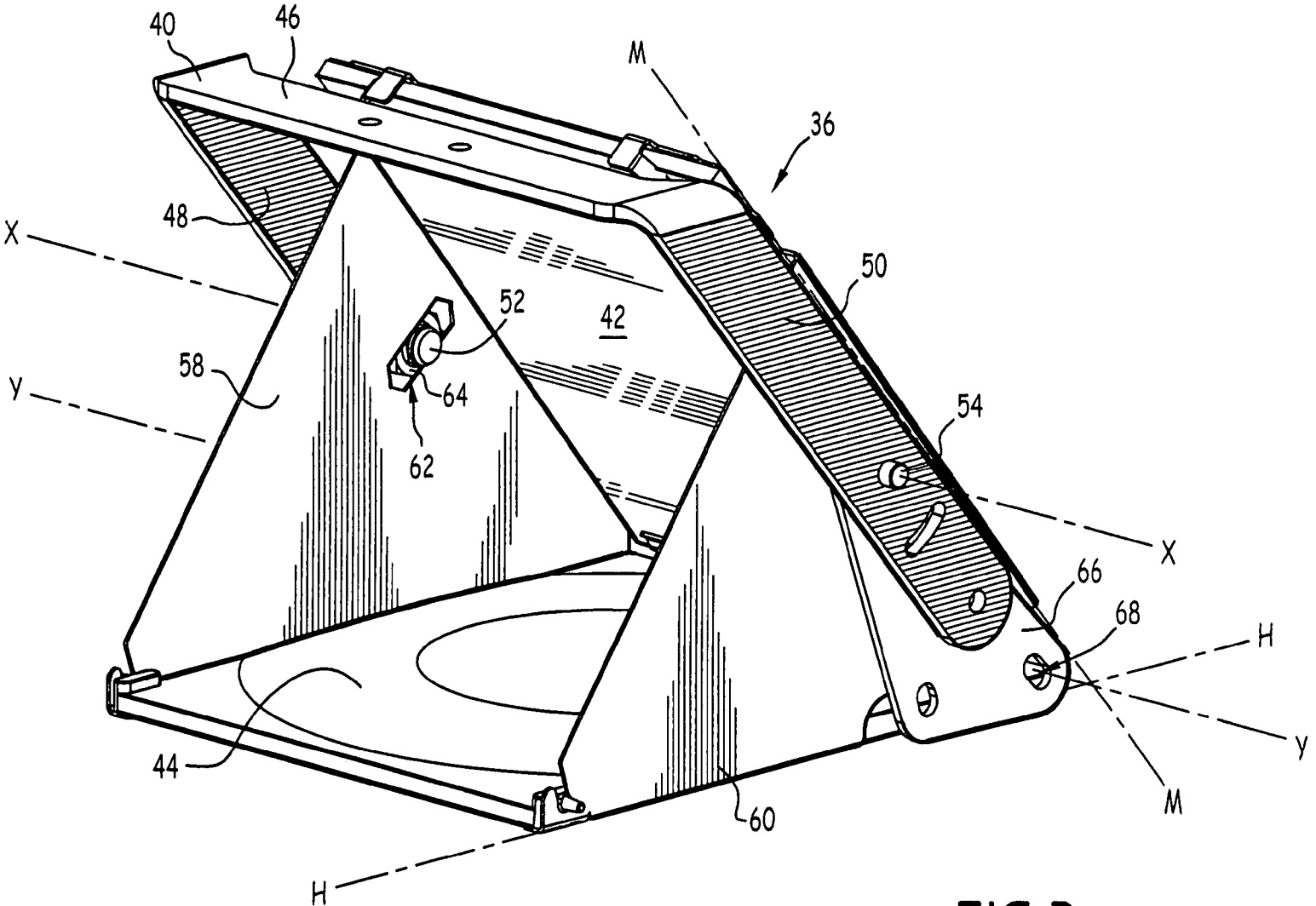
FIG. 3 is an enlarged perspective view of a movable optical assembly of the device of FIGS. 1 and 2.

A movable optical assembly 36 is illustrated in FIG. 3. This assembly 36 comprises a securing support 40, a reflecting mirror 42 and a focusing aperture 44.

The securing support 40 is a fitting which is in the form of an inverted U and which is fixed to the housing 12 and constituted by a web 46 which connects two arms 48, 50. Each arm 48, 50 is provided with a stud 52, 54 which is movable in rotation about an axis X—X.

The reflecting mirror 42 is a planar mirror which extends in a mirror plane M. The mirror 42 is reflective in the range of visible light and transparent in the infrared range. An optical processed layer 56 which is known per se is arranged on the mirror, at the side opposite the aperture (FIG. 1). This optical processed layer 56 serves to transmit the infrared rays towards the casing 12 in order to dissipate the energy of the infrared rays.

The focusing aperture 44 extends in an aperture plane H which defines an angle of between 40° and 50° with the plane M. The two planes H and M intersect along an axis of intersection Y—Y. The aperture 44 comprises a first dioptre lens and a second dioptre lens which are arranged coaxially one behind the other in the sense of travel of the rays of the beams F1. The first dioptre lens is suitable for correcting optical aberrations and the second dioptre lens is suitable for making uniform the illumination of the beam F1.

The mirror 42 and the aperture 44 are fixed to each other by two connection plates 58, 60 of generally triangular form which extend perpendicularly to the planes M and H. Each of the plates 58, 60 extends at an axial end of the mirror 42 and the aperture 44. The connection plates 58, 60, the mirror 42 and the aperture 44 therefore form a prism of triangular cross-section whose side located facing the mirror 42 and the aperture 44 is open.

The radial position of the mirror 42 and the aperture 44 can be adjusted relative to axis X—X. For this purpose, a rectilinear slot 62 is provided in each plate 58, 60. The associated stud 52, 54 extends through the slot 62 and is held in the slot by holding means, such as a nut 64.

In this manner, the plates 58, 60, the mirror 42 and the aperture 44 are articulated to the arms 48, 50 of the fitting about the axis of rotation X—X by means of the studs 52, 54.

The axis X—X extends in parallel with the planes H and M and is offset from these planes. Furthermore, the axis X—X intersects with the centre axis C—C of the associated beam F1, F2.

The assembly 36 further comprises a strut 66 which is fixed to the plate 60. The strut 66 comprises an opening 68, in which a drive finger is engaged which is not illustrated and which is connected to means for driving the strut 66, such as a geared motor (not illustrated). In this manner, the mirror 42 and the aperture 44 can be displaced angularly in a synchronous manner and in a single unit about axis X—X in order to modify the size of the illumination spot 6.

Each fixed optical assembly 38 comprises a reflecting mirror 42 and a focusing aperture which are similar to the mirror 42 and aperture 44 mentioned above. However, the mirror 42 and aperture 44 in this case are secured to the housing 12 and the positions thereof cannot be modified relative to the casing 10.

The illumination device according to the invention is assembled and operates as follows.

Firstly, the support 40 is secured in the casing 10. Subsequently, the position of the mirror 42 and the aperture 44 relative to the bulb 24 is pre-adjusted by the position of the plates 58, 60 being modified relative to the studs 52, 54.

When the operating field 4 is illuminated, the size of the illumination spot 6 can be adjusted by the mirrors 42 and the apertures 44 of the movable assemblies 36 being tilted about the axis X—X.

The provision of movable assemblies 36 and fixed assemblies 38 in the same casing 10 results in an illumination device which allows the size of the illumination spot 6 to be varied, whilst still being economical.

The fixed illumination assemblies 38 further ensure minimum illumination at the centre of the spot 6.

In general terms, it is preferable for half of the optical assemblies to be constituted by fixed assemblies 38 whilst the other half are constituted by movable assemblies 36. Similarly, it is preferable for half of the optical assemblies which are associated with a bulb to be constituted by movable assemblies 36 whilst the other half of the optical assemblies are constituted by fixed assemblies 38.

Since the mirror 42 and the aperture 44 of the movable assemblies 36 are fixed relative to each other, a modification of the position of the mirror 42 relative to the bulb 24 does not modify the position of the mirror 42 relative to the aperture 44. Consequently, the aberration of the light beam F1 which leaves the aperture 44 is still corrected in the same manner and it is not necessary partially to obscure this beam F1. This leads to good energy output of the device. Furthermore, the closure plate 14 can therefore be completely transparent and attractive.

By way of a variant, all the movable optical assemblies 36 are associated with one of the bulbs 24, 26 whilst all the fixed optical assemblies 38 are associated with the other bulb 26, 24.

The invention claimed is:

1. Device for illuminating an illumination field, in particular an operating field, comprising:

a casing comprising at least one means for securing a light source to emit at least separate first and second light beams;

at least one movable optical assembly constructed and arranged to the first light beam emitted by the light source towards the illumination field, wherein the movable optical assembly comprises:

a support for securing the assembly;

an optical focusing element; and a reflecting mirror constructed and arranged to reflect the first incident light beam from the at least one light source towards the optical focusing element in order to focus the first incident light beam onto an illumination plane, the reflecting mirror being movable relative to the securing support, the optical focusing element being movable relative to the securing support and comprising means for connecting the optical focusing element to the reflecting mirror for synchronised displacement of the optical focusing element and the reflecting mirror, wherein the optical focusing element is a through-aperture comprising a first dioptre lens and a second dioptre lens, the first dioptre lens being adapted for correcting optical aberrations, the second dioptre lens being adapted for making uniform the illumination over the illumination plane, the securing support being fixed to the casing; and a fixed optical assembly comprising:

a fixed reflecting mirror; and a fixed optical focusing element;

wherein the fixed reflecting mirror and the fixed optical focusing element are constructed and arranged to reflect the second incident beam of light emitted by the at least one light source toward the illumination field through the fixed optical focusing element, the fixed assembly being secured relative to the casing.

2. The device according to claim 1, wherein the connection means fixedly join the reflecting mirror to the optical focusing element for identical movement of the two of them.

3. The device according to claim 1, wherein the reflecting mirror defines an optical mirror plane and the optical focusing element defines an optical focusing plane, in that the two optical planes intersect along an axis of intersection (Y—Y), and in that the reflecting mirror and the optical focusing element are movable in rotation about an axis of rotation (X—X) which is parallel with the axis of intersection (Y—Y).

4. The device according to claim 2, wherein the reflecting mirror defines an optical mirror plane and the optical focusing element defines an optical focusing plane, in that the two optical planes intersect along an axis of intersection (Y—Y), and in that the reflecting mirror and the optical focusing element are movable in rotation about an axis of rotation (X—X).

5. The device according to claim 3, and comprising means for adjusting the relative position of the reflecting mirror and the optical focusing element relative to the axis of rotation (X—X) in a radial direction relative to this axis.

6. The device according to claim 4, and comprising means for adjusting the relative position of the reflecting mirror and the optical focusing element relative to the axis of rotation (X—X) in a radial direction relative to this axis.

7. Assembly according to claim 1, wherein the reflecting mirror and the optical focusing element are mutually connected by two connection plates which extend at one side and the other of the reflecting mirror and the optical focusing element.

8. Device according to claim 1, and comprising at least two said optical assemblies, of which half are said movable assemblies and the other half are said fixed assemblies.

9. Assembly according to claim 8, wherein the reflecting mirror and the optical focusing element are mutually connected by two connection plates which extend at one side and the other of the reflecting mirror and the optical focusing element.

10. Device according to claim 8, wherein half of the optical assemblies which are associated with a bulb are constituted by movable assemblies, and wherein the other half of the optical assemblies are fixed assemblies.

11. Assembly according to claim 8, wherein the connection means fixedly join the reflecting mirror to the optical focusing element for identical movement of the two of them.

12. Assembly according to claim 8, wherein the reflecting mirror defines an optical mirror plane and the optical focusing element defines an optical focusing plane, in that the two optical planes intersect along an axis of intersection (Y—Y), and in that the reflecting mirror and the optical focusing element are movable in rotation about an axis of rotation (X—X) which is parallel with the axis of intersection (Y—Y).

13. Assembly according to claim 11, wherein the reflecting mirror defines an optical mirror plane and the optical focusing element defines an optical focusing plane, in that the two optical planes intersect along an axis of intersection (Y—Y), and in that the reflecting mirror and the optical focusing element are movable in rotation about an axis of rotation (X—X).

14. Assembly according to claim 12, and comprising means for adjusting the relative position of the reflecting mirror and the optical focusing element relative to the axis of rotation (X—X) in a radial direction relative to this axis.

15. Assembly according to claim 13, and comprising means for adjusting the relative position of the reflecting mirror and the optical focusing element relative to the axis of rotation (X—X) in a radial direction relative to this axis.

16. Device according to claim 11, wherein half of the optical assemblies which are associated with a bulb are constituted by movable assemblies, and wherein the other half of the optical assemblies are fixed assemblies.

17. Device according to claim 12, wherein half of the optical assemblies which are associated with a bulb are constituted by movable assemblies, and wherein the other half of the optical assemblies are fixed assemblies.

18. Device according to claim 13, wherein half of the optical assemblies which are associated with a bulb are constituted by movable assemblies, and wherein the other half of the optical assemblies are fixed assemblies.

19. A device for illuminating an illumination field, comprising:

a casing comprising at least one light source emitting at least separate first and second light beams;

a plurality of optical assemblies disposed on the casing, each of the optical assemblies comprising:

a reflecting mirror; and an optical focusing element;

wherein each said reflecting mirror and associated said optical focusing element are disposed with respect to the at least one light source so as to reflect light from one of the separate first and second separate light beams off of the reflecting mirror and through the optical focusing element toward the illumination field;

wherein at least one of the optical assemblies is adjustable so as to allow the reflecting mirror and the associated optical focusing element to move with respect to the at least one light source so as to adjust light cast onto the illumination field, said at least one adjustable optical assembly receiving and reflecting the first light beam; and wherein at least one of the optical assemblies is not adjustable with respect to the light source, said non-adjustable optical assemblies receiving and reflecting the second light beam.

20. The device of claim 19, wherein the adjustable optical assembly is attached to the casing so as to allow the reflecting mirror and associated optical focusing element to move as a unit with respect to the at least one light source, so that the reflecting mirror and associated optical focusing element do not move with respect to one another.

* * * * *